US008309836B1

(12) United States Patent
Bolger et al.

(10) Patent No.: US 8,309,836 B1
(45) Date of Patent: Nov. 13, 2012

(54) MUSICAL INSTRUMENT PICKUP

(76) Inventors: David Thomas Bolger, Williamstown, NJ (US); Thomas Bolger, Hardwick, NJ (US)

( * ) Notice: Subject to any disclaimer, the term of this patent is extended or adjusted under 35 U.S.C. 154(b) by 32 days.

(21) Appl. No.: 13/158,422

(22) Filed: Jun. 12, 2011

(51) Int. Cl.
*G10H 3/00* (2006.01)

(52) U.S. Cl. ..... 84/723; 84/725; 84/726

(58) Field of Classification Search ..... None
See application file for complete search history.

(56) References Cited

U.S. PATENT DOCUMENTS

| | | | | |
|---|---|---|---|---|
| 4,269,103 | A | 5/1981 | Underwood | |
| 4,283,982 | A * | 8/1981 | Armstrong | 84/728 |
| 5,111,728 | A | 5/1992 | Blucher | |
| 5,399,802 | A * | 3/1995 | Blucher | 84/726 |
| 5,525,750 | A | 6/1996 | Beller | |
| 5,668,520 | A | 9/1997 | Kinman | |
| 5,792,973 | A | 8/1998 | Riboloff | |
| 5,834,999 | A | 11/1998 | Kinman | |
| 5,854,437 | A * | 12/1998 | Merrick et al. | 84/454 |
| 5,894,101 | A * | 4/1999 | Damm | 84/728 |
| 5,908,998 | A * | 6/1999 | Blucher et al. | 84/728 |
| 6,103,966 | A | 8/2000 | Kinman | |
| 6,121,537 | A | 9/2000 | Pawar | |
| 6,372,976 | B2 * | 4/2002 | Damm | 84/723 |
| 6,525,258 | B1 | 2/2003 | Powers | |
| 6,846,981 | B2 | 1/2005 | Devers | |
| 7,022,909 | B2 | 4/2006 | Kinman | |
| 7,166,793 | B2 * | 1/2007 | Beller | 84/723 |
| 7,189,916 | B2 | 3/2007 | Kinman | |
| 2005/0150364 | A1 | 7/2005 | Krozack | |
| 2005/0162247 | A1 | 7/2005 | Beller | |
| 2006/0112816 | A1 * | 6/2006 | Kinman | 84/728 |
| 2006/0156911 | A1 | 7/2006 | Stich | |
| 2009/0255397 | A1 | 10/2009 | Mulvany | |
| 2010/0122623 | A1 | 5/2010 | Salo | |
| 2012/0118129 | A1 * | 5/2012 | Jang | 84/726 |

FOREIGN PATENT DOCUMENTS

| | | |
|---|---|---|
| JP | 2005208659 | 5/2005 |

* cited by examiner

*Primary Examiner* — Marlo Fletcher
(74) *Attorney, Agent, or Firm* — Richard S. Finkelstein

(57) ABSTRACT

According to some embodiments, a musical instrument pickup comprises a first plurality of non-magnetic pole pieces a second plurality of non-magnetic pole pieces, a plurality of magnetic pole pieces, a first coil disposed around the first plurality of non-magnetic pole pieces, a second coil disposed around the second plurality of non-magnetic pole pieces and the plurality of magnetic pole pieces, and a bar magnet magnetically coupled to the first plurality of non-magnetic pole pieces and the second plurality of non-magnetic pole pieces.

16 Claims, 5 Drawing Sheets

MUSICAL INSTRUMENT PICKUP

BACKGROUND

Musical instrument pickups generate small electric signals corresponding to a frequency or frequencies of a note or notes being played. These electrical signals are created by one or more strings vibrating through a magnetic field. Musical instrument pickups, which are used for instruments such as a guitar, mandolin, bass, etc., fall into two general types, a single coil pickup and a double coil (i.e., humbucker) pickup.

The two types of musical instrument pickups work in different ways and each has its own characteristic sound. A conventional single coil pickup is composed of a plurality of magnets (e.g., one for each string) surrounded by copper wire. The single coil pickup has a characteristic sound having low notes that sound very clear and "twangy", while the high notes can sound quite shrill and piercing. The single coil pickup is also sensitive to 60 cycle hum.

A conventional double coil pickup, as illustrated in FIG. 1, includes two coils 101/102 wired in series and out of phase with each other. The conventional double coil pickup consists of a plurality of metal cylindrical elements (i.e. pole pieces) 105 and a plurality of metal screws 104. The plurality of pole pieces 105 and the plurality of metal screws 104 are not themselves magnetic. Rather, they conduct a magnetic field generated by a bar magnet 103 located under plastic bobbins that contain the cylinders and screws. The entire assembly is supported by a base plate 106. This pickup reduces 60 cycle hum and has a sound characterized by sweet, sonorous highs at the expense of indistinct, muddy sounding lows.

SUMMARY

According to some embodiments, a musical instrument pickup is disclosed. The musical instrument pickup comprises a first plurality of non-magnetic pole pieces a second plurality of non-magnetic pole pieces, a plurality of magnetic pole pieces, a first coil disposed around the first plurality of non-magnetic pole pieces, a second coil disposed around the second plurality of non-magnetic pole pieces and the plurality of magnetic pole pieces, and a bar magnet magnetically coupled to the first plurality of non-magnetic pole pieces and the second plurality of non-magnetic pole pieces.

BRIEF DESCRIPTION OF THE DRAWINGS

The accompanying drawings illustrate presently preferred embodiments, and together with the general description given above and the detailed description given below, serve to explain the principles of the present embodiments. As shown throughout the drawings, like reference numerals designate like or corresponding parts.

DETAILED DESCRIPTION

The several embodiments described herein are provided solely for the purpose of illustration. Embodiments may include any currently or hereafter-known versions of the elements described herein. Therefore, persons in the art will recognize from this description that other embodiments may be practiced with various modifications and alterations.

Figure 1:
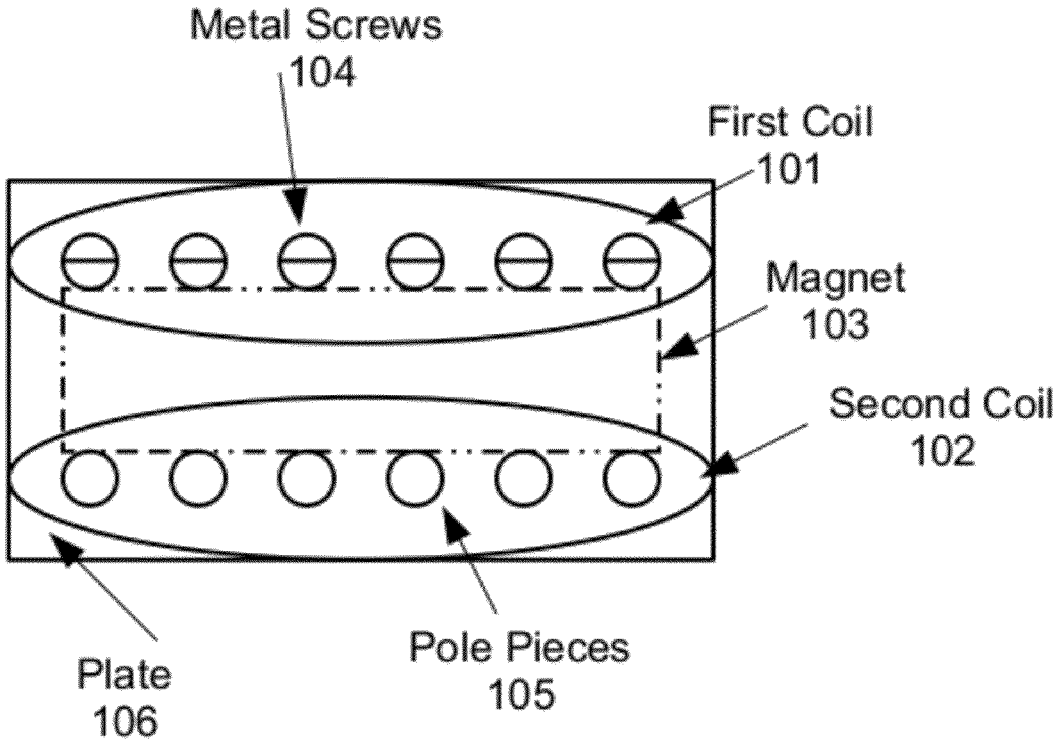
FIG. 1 (Prior Art)
FIG. 1 illustrates a conventional dual coil musical instrument pickup.
Figure 2:
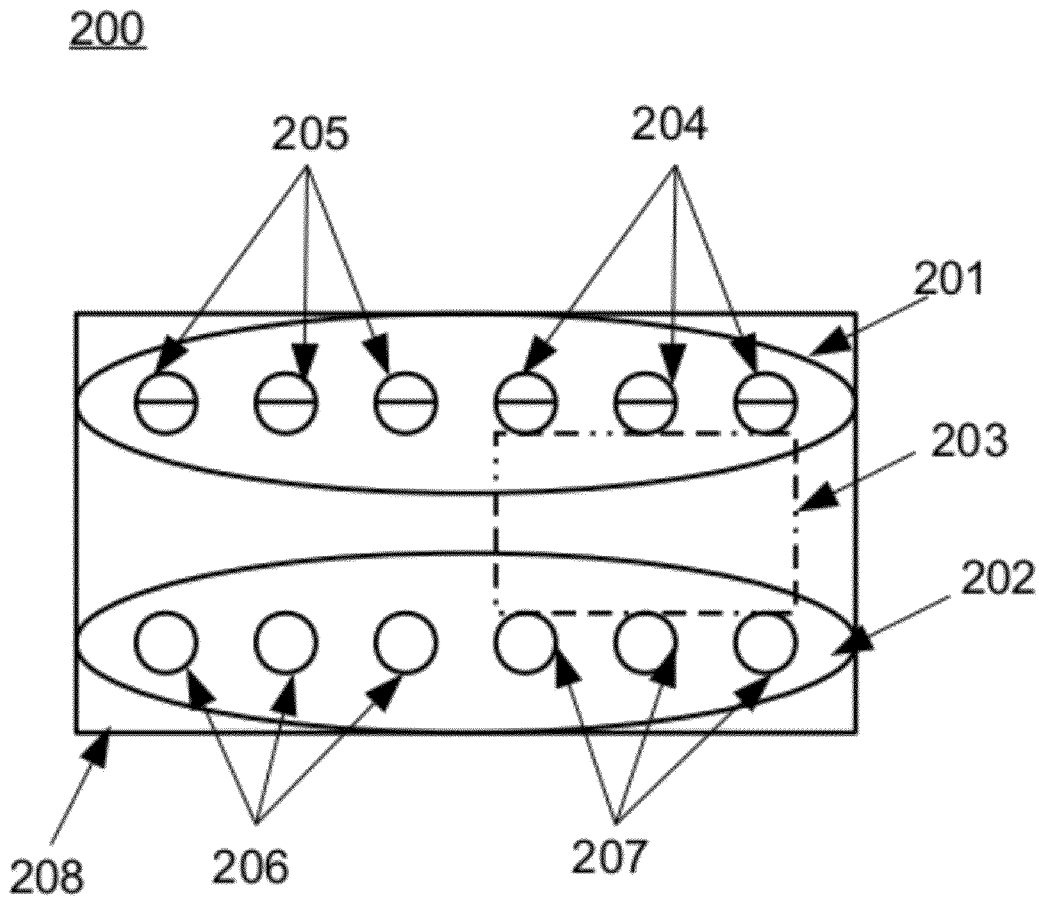
FIG. 2 illustrates a top view of a musical instrument pickup according to some embodiments.

Now referring to FIG. 2, an embodiment of a musical instrument pickup 200 is illustrated. The musical instrument pickup 200 comprises a first coil 201 and a second coil 202. The first coil 201 and the second coil 202 may be a same length and each may comprise wire coils that are wired in series or in parallel. The first coil 201 and the second coil 202 each comprise numerous turns of wire (not shown in FIG. 2), such as, but not limited to, copper wire. The first coil 201 and second coil 202 may be wound out of phase (e.g. opposing windings and polarities). In some embodiments, the first coil 201 and the second coil 202 are disposed side-by-side.

The musical instrument pickup 200 further comprises a bar magnet 203, a first plurality of non-magnetic pole pieces 204, a plurality of non-conductive pole pieces 205, a plurality of magnetic pole pieces 206, a second plurality of non-magnetic pole pieces 207, and a base plate 208. The musical instrument pickup may further comprise one or more spacers and/or shims (not shown).

In some embodiments, the first plurality of non-magnetic pole pieces 204, the second plurality of non-magnetic pole pieces 207 and the plurality of magnetic pole pieces 206 may be, but are not limited to, cylindrical shaped pole pieces, box shaped pole pieces, or screws. The magnetic pole pieces 206 may comprise any known magnet, such as, but not limited to, alnico magnets. The non-magnetic pole pieces 204/207, while not magnetic, can conduct a magnetic field associated with the bar magnet 203. In some embodiments, the non-magnetic pole pieces 204/207 comprise ferrous metals.

As illustrated in FIG. 2, the first coil 201 is disposed around (i.e., circumscribing) the first plurality of non-magnetic pole pieces 204. Similarly, the second coil 202 is disposed around the second plurality of non-magnetic pole pieces 207 and the plurality of magnetic pole pieces 206. A height of each of the plurality of magnetic pole pieces 206 may be greater than a height of the first coil 201 or the second coil 202. One or more pole pieces of the plurality of magnetic pole pieces 206 may extend through the base plate 208. A height of each of the pluralities of non-magnetic pole pieces 204/207 may be greater than a height of the first coil 201 or the second coil 202. Furthermore, the bar magnet 203 is magnetically coupled to the first plurality of non-magnetic pole pieces 204 and the second plurality of non-magnetic pole pieces 207. However, the bar magnet 203 is not magnetically coupled to the plurality of magnetic-pole pieces 206.

Figure 3:
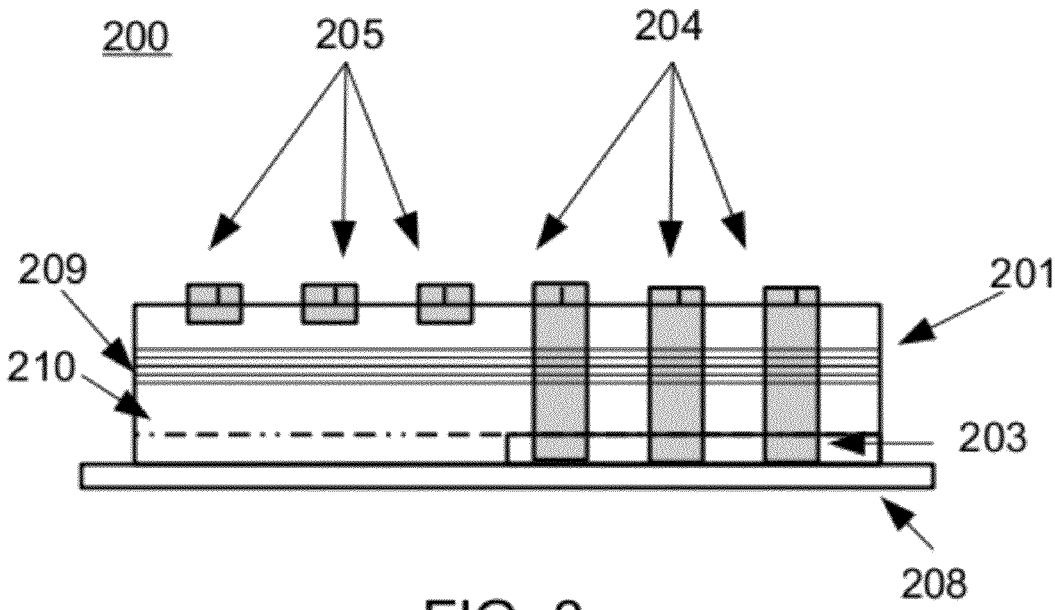
FIG. 3 illustrates a side view of a musical instrument pickup according to some embodiments.
Figure 4:
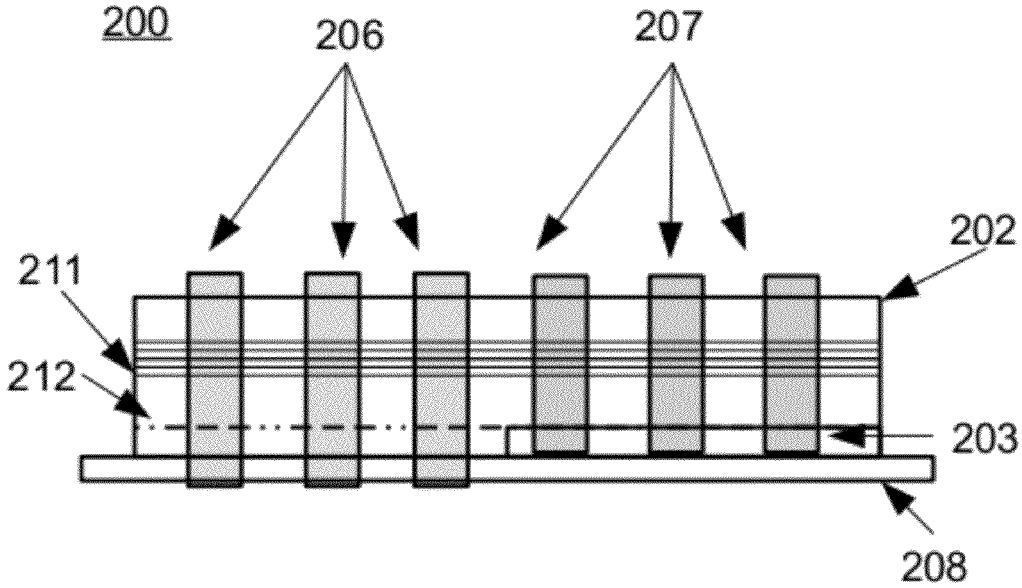
FIG. 4 illustrates a side view of a musical instrument pickup according to some embodiments.

Now referring to FIG. 3, and FIG. 4, side views of the first coil 201 and the second coil 202 are illustrated according to some embodiments. FIG. 3 discloses a side view of the first coil 201 and FIG. 4 discloses a side view of the second coil 202. The first coil 201 and the second coil 202 each comprise numerous turns of wire 209/211 that are disposed around respective bobbins 210/212. In some embodiments, each bobbin 210/212 is disposed adjacent to (e.g., above) the bar magnet 203. Each bobbin 210/212 may be oval shaped and thus the coils 201/202 may be oval shaped. However, in some embodiments, the bobbins 210/212 may be rectangular shaped or any other shape.

The bar magnet 203 is disposed below the first plurality of non-magnetic pole pieces 204 and the second plurality of non-magnetic pole pieces 207. However, in other embodiments, the first plurality of non-magnetic pole pieces 204 and the second plurality of non-magnetic pole pieces 207 are disposed on respective sides of the bar magnet 203. In some embodiments, the bar magnet 203 may comprise any known magnet, such as, but not limited to, an alnico magnet.

As illustrated, the plurality of magnetic pole pieces 206 are not magnetically coupled to the bar magnet 203. The plurality of magnetic pole pieces 206 may be longer than the first plurality of non-magnetic pole pieces 204 or the second plurality of non-magnetic pole pieces 207.

For illustrative purposes, and to aid in understanding features of the present disclosure, an example will now be introduced. This example is not intended to limit the scope of the present embodiments.

In an example of a musical instrument pickup that is associated with a six-string guitar, the plurality of magnetic pole pieces 206 may comprise three magnetic pole pieces each placed under a respective string such as a low E, A, and D strings. This has the effect of the music instrument pickup functioning with the sound characteristics of a single coil pickup such that the low strings produce sounds synonymous with a single coil pickup. Continuing with the example, the first plurality of non-magnetic pole pieces 204 comprises three non-magnetic pole pieces, and the second plurality of non-magnetic pole pieces 207 comprises three non-magnetic pole pieces. The non-magnetic pole pieces 204/207 are placed respectively under the G, B and high E strings (i.e., one from each plurality of non-magnetic pole pieces is placed under each of the G, B, and high E strings). This has the effect of the music instrument pickup functioning with the sound characteristics of a double coil pickup such that the high strings produce sounds synonymous with a double coil pickup. In some embodiments, this arrangement allows for a musical instrument pickup to have a sound characteristic having low notes that sound very clear and "twangy", while the high notes sound sweet and sonorous. Furthermore, this arrangement is resistive to 60 cycle hum.

The present embodiments of a musical instrument pickup are not limited to a ratio of one magnetic pole piece to every two non-magnetic pole pieces. For example, in a case of a seven-string guitar, a musical instrument pickup may comprise four magnetic pole pieces 206 while the first plurality of non-magnetic pole pieces 204 comprises three non-magnetic pole pieces, and the second plurality of non-magnetic pole pieces 207 comprises three non-magnetic pole pieces. Or, for example, a musical instrument pickup for the six-string guitar may comprise two magnetic pole pieces 206 while the first plurality of non-magnetic pole pieces 204 comprises four non-magnetic pole pieces, and the second plurality of non-magnetic pole pieces 207 comprises four non-magnetic pole pieces.

Furthermore, a size of the bar magnet 203 may be proportional to a number of magnetic pole pieces 206 that are magnetically coupled to the bar magnet 203. For example, a six-string guitar comprising three non-magnetic pole pieces 204 and three non-magnetic pole pieces 207 will have a bar magnet 203 associated with the number of the non-magnetic pole pieces 204/207. However, in a case of a six-string guitar comprising two magnetic pole pieces 206, four non-magnetic pole pieces 204, and four non-magnetic pole pieces 207, a size of the bar magnet 203 will generally be larger than the pickup associated with the six-string guitar comprising three non-magnetic pole pieces 204 and three non-magnetic pole pieces 207.

In some embodiments, the musical instrument pickup may comprise a plurality of non-conductive pole pieces 205. The non-conductive pole pieces may be comprised of plastic or any known material that does not conduct magnetism.

Figure 5:
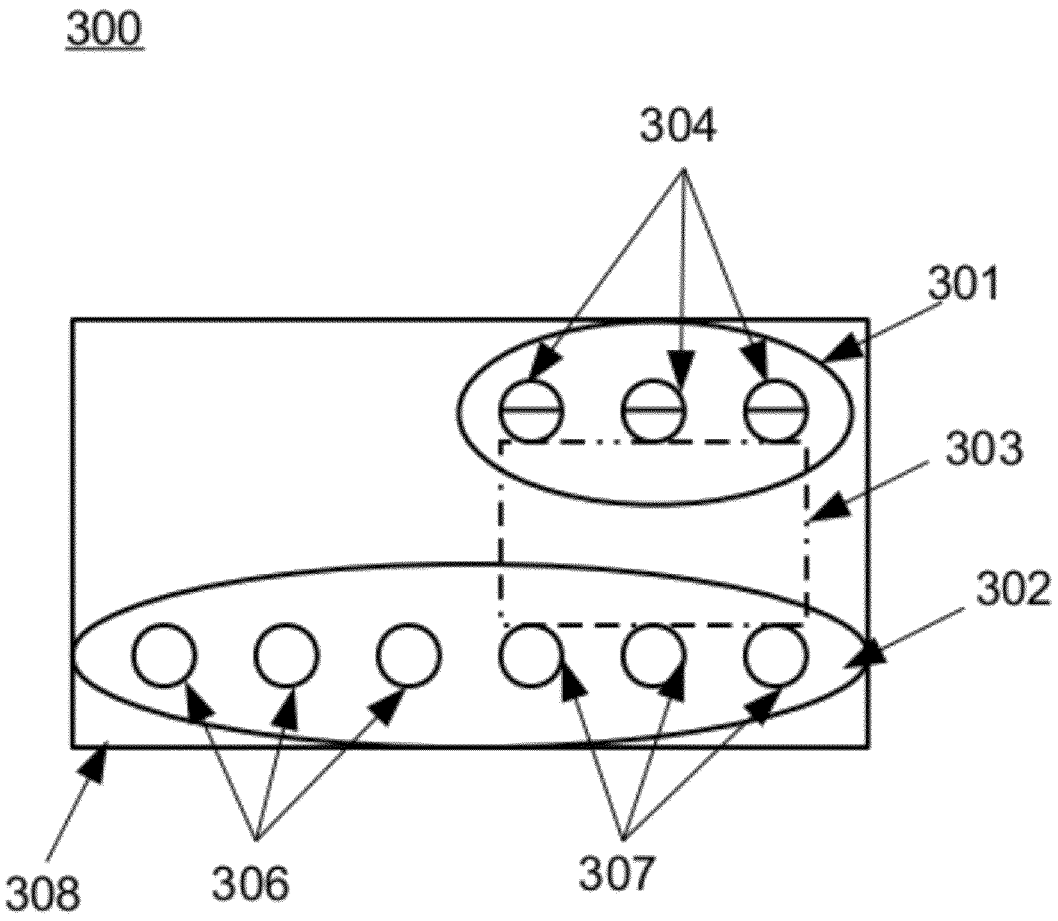
FIG. 5 illustrates a top view of a musical instrument pickup according to some embodiments.

Now referring to FIG. 5, an embodiment of a musical instrument pickup 300 is illustrated. Similar to the musical instrument pickup 200, the musical instrument pickup 300 comprises a first coil 301, a second coil 302, a bar magnet 303, a first plurality of non-magnetic pole pieces 304, a plurality of non-conductive pole pieces 305, a plurality of magnetic pole pieces 306, a second plurality of non-magnetic pole pieces 307, and a base plate 308.

In the present embodiment, a length of the first coil 301 is associated with an amount of non-magnetic pole pieces 304 and/or a size of the bar magnet 303. Therefore, the length of the first coil 301 may be different than a length of the second coil 302. The first coil 301 and the second coil 302 may each be associated with different sized bobbins, or may be associated with same size bobbins. For example, a bobbin (not shown) may comprise one or more openings that facilitate a wire being wound at different coil lengths. The present embodiment may use less wire than a conventional dual coil pickup and have a sound characteristic having low notes that sound clear and "twangy" and high notes that sound sweet and sonorous.

Figure 6:
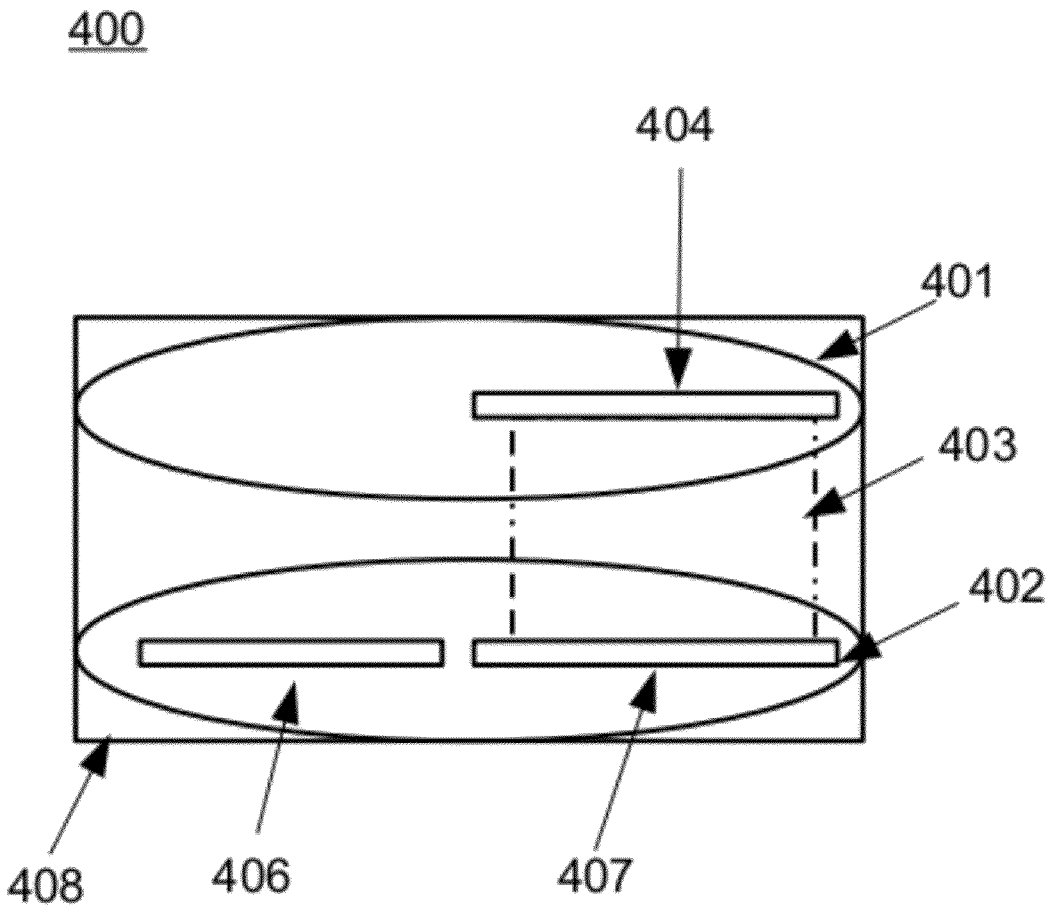
FIG. 6 illustrates a top view of a musical instrument pickup according to some embodiments.

Now referring to FIG. 6, an embodiment of a musical instrument pickup 400 is illustrated. Similar to the musical instrument pickup 200, the musical instrument pickup 400 comprises a first coil 401, a second coil 402, a bar magnet 403, and a base plate 408. In the present embodiment, the musical instrument comprises a first blade 404 and a second blade 407 which function as pole pieces. The present embodiment further comprises a magnetic blade 406 which functions as a magnetic pole piece. Each blade 404/407 may comprise a non-magnetic material for conducting a magnetic field associated with the bar magnet 403. Each blade 404/407 may function as a single pole piece that may be used in lieu of a plurality non-magnetic pole pieces. The magnetic blade 406 may function as a single pole piece that may be used in lieu of a plurality magnetic pole pieces. In some embodiments, the magnetic blade 406 may comprise an alnico magnetic blade.

The several embodiments described herein are solely for the purpose of illustration. Persons skilled in the art will recognize from this description that other embodiments may be practiced with modifications and alterations limited only by the claims.

What is claimed is:

1. A musical instrument pickup, comprising:

a first plurality of non-magnetic pole pieces;

a second plurality of non-magnetic pole pieces;

a plurality of magnetic pole pieces;

a first coil disposed around the first plurality of non-magnetic pole pieces;

a second coil disposed around the second plurality of non-magnetic pole pieces and the plurality of magnetic pole pieces; and a bar magnet magnetically coupled to the first plurality of non-magnetic pole pieces and the second plurality of non-magnetic pole pieces, wherein the plurality of magnetic pole pieces are not magnetically coupled to the bar magnet.

2. The musical instrument pickup of claim 1, further comprising:

a plurality of non-conductive pole pieces.

3. The musical instrument pickup of claim 1, wherein the plurality of magnetic pole pieces comprise alnico magnets.

4. The musical instrument pickup of claim 1, wherein the first plurality of non-magnetic pole pieces comprise screws.

5. The musical instrument pickup of claim 1, wherein the first coil is oval shaped.

6. The musical instrument pickup of claim 1, wherein the first plurality of non-magnetic pole pieces and the second plurality of non-magnetic pole pieces comprise an equal number of pole pieces.

7. The musical instrument pickup of claim 1, wherein the second plurality of non-magnetic pole pieces and the plurality of magnetic pole pieces comprise an equal number of pole pieces.

8. The musical instrument pickup of claim 1, wherein the second plurality of non-magnetic pole pieces and the plurality of magnetic pole pieces are cylindrical shaped.

9. The musical instrument pickup of claim 1, wherein the bar magnet is disposed beneath the first coil and the second coil.

10. The musical instrument pickup of claim 1, further comprising:

a base plate, wherein one or more of the plurality of magnetic pole pieces extends through the base plate.

11. A musical instrument pickup comprising:

one or more first non-magnetic pole pieces;

one or more second non-magnetic pole pieces;

one or more magnetic pole pieces;

a first coil disposed around the one or more first non-magnetic pole pieces;

a second coil disposed around the one or more second non-magnetic pole pieces and one or more magnetic pole pieces; and a bar magnet magnetically coupled to the one or more first non-magnetic pole pieces and the one or more second non-magnetic pole pieces, wherein the bar magnet is not coupled to the one or more magnetic pole pieces.

12. The musical instrument pickup of claim 11, wherein the one or more first non-magnetic pole pieces comprises screws.

13. The musical instrument pickup of claim 11, wherein the one or more first non-magnetic pole pieces comprises a blade.

14. The musical instrument pickup of claim 11, wherein the one or more first non-magnetic pole pieces and one or more first non-magnetic pole pieces comprise a blade.

15. The musical instrument pickup of claim 11, wherein the bar magnet is disposed beneath the first coil and the second coil.

16. The musical instrument pickup of claim 11, wherein the one or more magnetic pole pieces comprise an alnico magnetic blade.

* * * * *